United States Patent [19]

Mochizuki et al.

[11] Patent Number: 5,049,538

[45] **Date of Patent: * Sep. 17, 1991**

[54] SUBLIMATION TYPE THERMOSENSITIVE IMAGE TRANSFER RECORDING MEDIUM, AND THERMOSENSITIVE RECORDING METHOD USING THE SAME

[75] Inventors: Hidehiro Mochizuki, Numazu; Akira Suzuki, Mishima; Masaru Shimada, Shizuoka; Hiroyuki Uemura, Numazu, all of Japan

[73] Assignee: Ricoh Company, Ltd., Tokyo, Japan

[ * ] Notice: The portion of the term of this patent subsequent to Nov. 14, 2006 has been disclaimed.

[21] Appl. No.: 392,605

[22] Filed: Aug. 11, 1989

[30] Foreign Application Priority Data

Sep. 7, 1988 [JP] Japan ..... 63-224151
Oct. 26, 1988 [JP] Japan ..... 63-268204

[51] Int. Cl.[5] ..... B41M 5/035; B41M 5/26

[52] U.S. Cl. ..... 503/227; 8/471; 428/195; 428/212; 428/913; 428/914

[58] Field of Search ..... 8/471; 428/195, 212, 428/913, 914; 503/227

[56] References Cited

U.S. PATENT DOCUMENTS 4,650,494 3/1987 Kutsukake et al. ..... 8/471

FOREIGN PATENT DOCUMENTS 0192435 8/1986 European Pat. Off. ..... 503/227

*Primary Examiner*—Bruce H. Hess

*Attorney, Agent, or Firm*—Oblon, Spivak, McClelland, Maier & Neustadt

[57] ABSTRACT

A sublimation type thermosensitive image transfer recording medium and a thermosensitive recording method using the sublimation type thermosensitive image transfer recording medium are disclosed, which comprises a support, an ink layer formed on the support, comprising (a) a dye supplying layer formed on the support, comprising a sublimable dye and at least one binder agent in which the sublimable dye is dispersed in the form of undissolved granules, and (b) an image transfer facilitating layer formed on the dye supplying layer, comprising the sublimable dye and at least one organic binder agent in which the sublimable dye is dissolved, in which the dye supplying layer and the image transfer facilitating layer are constructed in such a manner that (i) the concentration of the sublimation dye in the dye supplying layer is greater than that of the sublimable dye in the image transfer facilitating layer or (ii) the diffusion coefficient of said sublimable dye in the dye supplying layer is greater than that of the sublimable dye in the image transfer facilitating layer.

66 Claims, 4 Drawing Sheets

SUBLIMATION TYPE THERMOSENSITIVE IMAGE TRANSFER RECORDING MEDIUM, AND THERMOSENSITIVE RECORDING METHOD USING THE SAME

BACKGROUND OF THE INVENTION

1. Field of the Invention

The present invention relates to a sublimation type thermosensitive image transfer recording medium, and a thermosensitive recording method using the thermosensitive image transfer recording medium.

2. Discussion of Background

Recently a demand for full color printers is increasing year by year. Representative recording methods for full color printers now available include the electrophotographic method, the ink-jet method, and the thermosensitive image transfer method. Of these methods, the thermosensitive image transfer method is most widely employed because of its advantages over the other methods in that maintenance is easy and operation is noiseless.

In the thermosensitive image transfer recording method, a solidified color ink sheet and a receiving sheet are employed, and a color ink is transferred imagewise from the ink sheet to the receiving sheet due to the thermal fusion of the ink or the sublimation of the ink, under the application of thermal energy by a laser beam or a thermal head which is controlled by electric signals.

Thus, the thermosensitive image transfer recording method can be roughly classified into two types, a thermal fusing image transfer type and a sublimation image transfer type. The sublimation image transfer type is advantageous over the thermal fusing type in that halftone can be obtained without difficulty and image gradation can be controlled as desired. These benefits exist because a sublimable dye is in principle sublimated in the form of independent molecules in such an amount as to correspond to the amount of thermal energy applied thereto, for instance, through a thermal head. Therefore, the sublimation image transfer type is considered the most suitable for color printers.

The sublimation image transfer recording method, however, has a shortcoming in that its running cost is high, because in this image transfer method, a yellow ink sheet, a magenta ink sheet, a cyan ink sheet, and when necessary, a black ink sheet, have to be employed in order to obtain a full-color image, with selective application of thermal energy to each ink sheet, and discarded after the recording, even though large unused portions remain on each ink sheet.

In order to eliminate this shortcoming, the following proposals have been made: (1) an equal speed mode in which an ink sheet and a receiving sheet are moved at the same speed for using the ink sheet in repetition and (2) an N-times use mode in which the running speed of the ink sheet is made lower than that of the receiving sheet so that the overlappingly used portions of the ink sheet at the first use and the second use are shifted little by little.

In the sublimation type thermosensitive image transfer recording method, the sublimation and evaporation reaction is fundamentally a reaction of zero order. Therefore, in the equal speed mode, the ink sheet cannot be used multiple times for printing because the printed image density significantly decreases as the number of printings increases, particularly in high image density areas, even though a sufficient amount of a dye for multiple printing is contained in the ink layer of the ink sheet.

In order to improve the drastic decrease in transferred image density during multiple printing, the inventors of the present invention proposed a sublimation type thermosensitive image transfer recording medium comprising a dye supplying layer and an image transfer facilitating layer in Japanese Laid-Open Patent Application 63-62866. In this recording medium, the sublimable dye discharging performance of the dye supplying layer is made greater than that of the image transfer facilitating layer.

However, the image density transferred from the above recording medium was still unsatisfactory, especially in high image density areas.

SUMMARY OF THE INVENTION

It is therefore an object of the present invention to provide a sublimation type thermosensitive image transfer recording medium, which does not cause drastic decrease in transferred image density even when it is used repeatedly, is free from exfoliation of an ink layer, and does not bring about improper running of an ink sheet.

Another object of the present invention is to provide a thermosensitive recording method using the above sublimation type thermosensitive image transfer recording medium, which can overcome the drawbacks in the conventional printing method of the N-time use mode.

The first object of the present invention is attained by a sublimation type thermosensitive image transfer recording medium comprising a support, an ink layer formed on the support, which comprises (a) a dye supplying layer formed on the support, comprising a sublimable dye and at least one binder agent in which the sublimable dye is dispersed in the form of undissolved granules, and (b) an image transfer facilitating layer formed on the dye supplying layer, comprising the sublimable dye and at least one organic binder agent in which the sublimable dye is dissolved, the dye supplying layer and the image transfer facilitating layer being constructed in such a manner that (1) the concentration of the sublimation dye in the dye supplying layer is greater than that of the sublimable dye in the image transfer facilitating layer or (2) the diffusion coefficient of the sublimable dye in the dye supplying layer is greater than that of the sublimable dye in the image transfer facilitating layer.

The second object of the present invention is attained by a thermosensitive recording method comprising the steps of superimposing the above sublimation type thermosensitive image transfer recording medium on a receiving sheet, and applying heat imagewise to the sublimation type thermosensitive image transfer recording medium so as to transfer imagewise the sublimable dye from the recording medium to the receiving sheet by a heat application recording means as the recording medium and the receiving sheet are moved at an equal speed or moved in such a manner that the running speed of the recording medium is smaller than that of the receiving sheet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Referring now to the accompanying drawings, the present invention will be explained in more detail.

Figure 1:
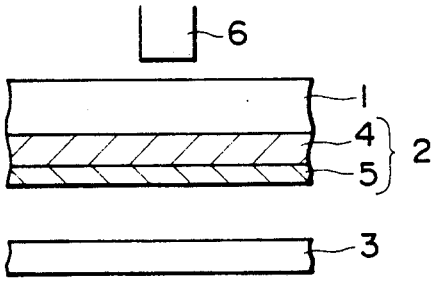
FIG. 1 is a schematic illustration in explanation of the structure of a sublimation type thermosensitive image transfer recording medium according to the present invention.

The basic structure of a sublimation type thermosensitive image transfer recording medium according to the present invention is schematically illustrated in FIG. 1. In this figure, reference numeral 1 denotes a support, reference numeral 2 denotes an ink layer, reference numeral 4 denotes a dye supplying layer, reference numeral 5 denotes an image transfer facilitating layer, reference numeral 3 denotes an image receiving layer, and reference numeral 6 denotes a thermal head.

In the present invention, it is preferable to employ as the support an aromatic polyamide film backed with a heat-resistant releasing layer. In this case, the dye supplying layer 4 is formed on the opposite side to the heat-resistant lubricating layer.

The inventors of the present invention proposed a sublimation type thermosensitive image transfer recording medium in Japanese Laid-Open Patent Application 63-62866, of which basic structure is the same as that of the recording medium of the present invention shown in FIG. 1.

In this recording medium, the dye supplying layer and the image transfer facilitating layer are structured in such a manner that if the dye supplying layer and the image transfer facilitating layer are separately formed on a substrate, and they are separately superimposed on the same receiving sheet, and the same quantity of thermal energy is applied thereto, the amount (weight/unit time·unit area) of the sublimable dye transferred from the dye supplying layer to the receiving sheet is greater than the amount (weight/unit time·unit area) of the sublimable dye transferred from the image transfer facilitating layer to the receiving sheet.

The present invention has been accomplished by improving the above sublimation type thermosensitive image transfer recording medium.

The inventors of the present invention found that it is possible to obtain printed images with high density and good gradation by incorporating a sublimable dye in the form of undissolved granules into the dye supplying layer of the above recording medium. This finding has been motivated by the following two facts:

(i) The dye concentration in the Fick's low is directed only to the concentration of a dye which is dissolved in the dye supplying layer and can diffuse when thermal recording is conducted, and a dye existing in the form of undissolved granules does not contribute to the dye concentration at all regardless of its amount. For this reason, the gradient of the dye concentration between the dye supplying layer and the image transfer facilitating layer does not exceed a specific value even when a large amount of the dye exists in the form of undissolved granules in the dye supplying layer.

(ii) When thermal recording is conducted, the dye dissolved in the dye supplying layer is supplied to the image transfer facilitating layer, and, at the same time, a part of the dye in the form of undissolved granules contained in the dye supplying layer is diffused and dissolved in the dye supplying layer. Therefore, the dye concentration in the dye supplying layer is kept constant as long as the dye exists therein in the form of undissolved granules.

Therefore, when the gradient of dye concentration and/or the gradient of diffusion coefficient is properly maintained between the dye supplying layer and the image transfer facilitating layer by allowing a dye to exist in the dye supplying layer in the form of undissolved granules, a recording medium capable of performing multiple printing can be obtained.

The dye supplying layer containing the dye in the form of undissolved granules can be obtained in the following manner. When an ink for the dye supplying layer is prepared, the sublimable dye is not completely dissolved in a solvent and/or an organic binder agent so that a part of the dye can remain undissolved. This ink is coated onto the support, and dried. Thus, the dye supplying layer containing the dye in the form of undissolved granules can be obtained. The dye-granules thus obtained can be readily identified by an electron microscope. The diameter of the dye-granules is preferably 0.01 μm to 20 μm, preferably 1.0 μm to 5 μm, for use in the present invention.

On the other hand, it is preferable that the sublimable dye be dissolved completely in the image transfer facilitating layer. Such an image transfer facilitating layer can stably keep the above-described gradient of dye concentration proper, and can provide images with uniform density.

In the present invention, Fick's law can be applied to the diffusion of a dye contained in the dye supplying layer and the image transfer facilitating layer which constitute an ink layer. More specifically, the amount (dn) of the dye which passes through a sectional area (q) of the ink layer for a period of time (dt) is represented by the following equation:

$$dn = -\overline{D}(dc/dx)qdt$$

where dc/dx is the dye concentration gradient in the direction of the diffusion of the dye, and $\overline{D}$ is the average diffusion coefficient in each section of the ink layer.

In order to facilitate the diffusion of a sublimable dye from the dye supplying layer to the image transfer facilitating layer, the following two methods are available:

(1) The concentration of the dye in the dye supplying layer is made greater than that of the dye in the image transfer facilitating layer.

(2) The diffusion coefficient of the dye in the dye supplying layer is made greater than that of the dye in the image transfer facilitating layer.

Specific means for carrying out the second method are described, for example, in "Fiber Association Journal" (Sen'i Gakkaishi) Vol. 30, No. 12 (1974) by Toyoko Sakai et al; "Dyeing Theoretical Chemistry" by Norihiko Kuroki (published by Maki Shoten), page 503; and "First Non-impact Printing Technologies Symposium Papers" Nos. 3, 4 and 5.

With reference to the above articles, more specific methods for carrying out the second method are as follows:

(a) A method of using as the organic binder agent in the image transfer facilitating layer an organic polymeric material having more proton-donating groups or proton-accepting groups, with which sublimable dyes may more easily form hydrogen bonds than an organic binder agent in the dye supplying layer, since the diffusion coefficient of a dye is effected by an energy control effect on the diffusion of the dye, such as the hydrogen bond between the dyes and organic binder agents. In other words, according to this method, in the image transfer facilitating layer, there is employed an organic binder agent having a greater capability of bonding with the sublimation dye than the capability of the organic binder agent of bonding with the sublimation dye in the dye supplying layer.

(b) A method of using an organic binder agent in the dye supplying layer, which has a lower glass transition temperature or a lower softening point than the glass transition or softening point of an organic binder agent contained in the image transfer facilitating layer, since the diffusion coefficient of the dye depends upon the glass transition temperature or the softening point of the organic binder agent in which the dye is dispersed, more specifically, the lower the glass transition temperature or softening point of the organic binder agent in which the dye is dispersed, the higher the diffusion coefficient of the dye.

(c) A method of containing a plasticizer in the dye supplying layer, which is compatible with at least one organic binder agent in the dye supplying layer, but not compatible with any of organic binder agents contained in the image transfer facilitating layer.

(d) A method of using any or all of the above-mentioned methods (a), (b) and (c) in combination.

As a matter of course, any other methods capable of satisfying the above-mentioned relationship concerning the diffusion coefficient can be employed.

When designing the formulations of the dye supplying layer and the image transfer facilitating layer for use in the present invention, the above-mentioned methods (1) and (2) are useful. Whether or not the desired effect is attained by any of the above methods can be easily confirmed by separately forming the dye supplying layer and the image transfer facilitating layer on a substrate, with an equal deposition amount of the components of each layer with each formulation, superimposing each of the dye supplying layer and the image transfer layer on a receiving sheet, and applying an equal amount of thermal energy thereto for sublimation of the dyes from the two layers onto the receiving sheet, to confirm the relationship that the amount (weight/unit time·unit area) of the sublimable dye transferred from the dye supplying layer to the receiving sheet is greater than the amount (weight/unit time·unit area) of the sublimable dye transferred from the image transfer facilitating layer to the receiving sheet.

The dye supplying layer generally has a thickness in the range of 0.1 μm to 20 μm, preferably in the range of 0.5 μm to 10 μm, while the image transfer facilitating layer generally has a thickness in the range of 0.05 μm to 5 μm, preferably in the range of 0.1 μm to 2 μm.

The sublimable dyes which can be used in the dye supplying layer and the image transfer facilitating layer are those conventionally employed, which are volatilized or sublimed at 60° C. or above, specifically those employed in thermal transfer printing, for example, disperse dyes and oil-soluble dyes. Specific examples of such dyes are C.I. Disperse Yellow 1, 3, 8, 9, 16, 41, 54, 60, 77 and 116; C.I. Disperse Red 1, 4, 6, 11, 15, 17, 55, 59, 60, 73 and 83; C.I. Disperse Blue 3, 14, 19, 26, 56, 60, 64, 72, 99 and 108; C.I. Solvent Yellow 77 and 116; C.I. Solvent Red 23, 25 and 27; and Solvent Blue 36, 83 and 105. These dyes can be used either singly or in combination.

The binder agents which can be used in the dye supplying layer and the image transfer facilitating layer are thermoplastic resins and thermosetting resins. Of those resins, examples of the resins having relatively high glass transition points or relatively high softening points are vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-containing resin, butyral resin, melamine resin, natural rubber, synthetic rubber, polyvinyl alcohol, and cellulose resins. These resins can be used either singly or in combination, or in the form of copolymers.

In order to make the dye supplying layer and the image transfer facilitating layer different in terms of the glass transition temperature or softening point thereof, resins and natural or synthetic rubbers having glass transition temperatures of 0° C. or less, or softening points of 60° C. or less may be employed for the dye supplying layer.

Specific examples of such resins, natural rubbers and synthetic rubbers are as follows:

Syndiotactic 1,2-polybutadiene (commercially available from Japan Synthetic Rubber Co., Ltd. under the trademarks of JSR RB810, 820, and 830), olefin copolymers and terpolymers containing acidic or non-acidic acids (commercially available from Dexon Chemical Co., Ltd. under the trademarks of Dexson XEA-7), ethylene-vinyl acetate copolymers (commercially available from Allied Fibers & Plastics under the trademarks of 400 & 400A, 405 and 430; and from Du Pont - Mitsui Polychemicals Co., Ltd. under the trademarks of P-3307 (EV150) and P-2807(EV250)); low-molecular weight polyolefin polyols and derviatives thereof (commercially available from Mitsubishi Chemical Industries, Ltd. under the trademarks of Polytail H, and HE); brominated epoxy resins (commercially available from Toto Chemical Co., Ltd. under the trademarks of YDB-340, 400, 500 and 600); novolak type epoxy resins (commercially available from Toto Chemical Co., Ltd. under the trademarks of YDCN-701, 702 and 703); thermoplastic acryl solutions (commercially available from Mitsubishi Rayon Engineering Co., Ltd. under the trademarks of Dianal LR1075, 1080, 1081, 1082, 1063 and 1079); thermoplastic acryl emulsions (commercially available from Mitsubishi Rayon Engineering Co., Ltd. under the trademarks of LX-400 and LX-450); polyethylene oxides (commercially available from Meisei Chemical Works, Ltd. under the trademarks of Alkox E-30 and 45, and Alkox R-150, 400 and 1000); caprolactone polyols (commercially available from Daicel Chemical Industries, Ltd. under the trademarks of Placcel H-1, 4 and 7). Of the above, the polyethylene oxides and the polycaprolactone polyols are particularly preferable for use in practice. It is also preferable that these resins be used in combination with the previously mentioned one or more thermoplastic or thermosetting resins.

In order to prevent the dye in the form of undissolved granules contained in the dye supplying layer from aggregating and to improve the adhesion between the dye supplying layer and the support, thereby preventing the transferred images from decreasing in image density or the ink layer from being peeled off the support while in repeated use of the recording medium, a reaction product of an isocyanate and a polymeric compound having an active hydrogen can be incorporated into the dye supplying layer.

Examples of the polymeric compound having an active hydrogen include polyvinyl butyral, polyvinyl acetal, polyurethane polyol, polyether polyol, polyester polyol, acrylic resin, an acryl-polyester copolymer, alkyd resin, silicone polyester, epoxy resin whose epoxy ring is opened with alkanolamine and converted so as to have a —OH group.

Of these polymeric compounds, polyvinyl butyral is preferable. Polyvinyl butyral moderately reacts with the dye employed in the dye supplying layer, so that it can serve as a barrier to the diffusion of the dye, and can also contribute to ribbon-preservability.

Examples of the isocyanate include diisocyanates and triisocyanates, more specifically, 2,4-tolylene diisocyanate, 2,6-tolylene diisocyanate, 4,4'-diphenylmethane diisocyanate, hexamethylene diisocyanate, xylene diisocyanate, triphenylmethane triisocyanate, isophorone diisocyanate, bisisocyanate methylcyclohexane, and trimethylhexamethylene diisocyanate.

From the handling point of view, "CORONATE L" (trademark), a commercial product of Nippon Polyurethane Industry Co., Ltd., and "TAKENATE D" (trademark), a commercial product of Takeda Chemical Industries, Ltd., are preferably employed as the isocyanate component.

It is preferable to blend the isocyanate and the polymeric compound having an active hydrogen in such an amount that the ratio of —NCO groups contained in the isocyanate to —OH groups contained in the polymeric compound is in the range of from 0.1:1 to 1:1.

The concentration of the sublimable dye contained in the image transfer facilitating layer is preferably in the range of 5 wt.% to 80 wt.%, more preferably in the range of about 10 wt.% to 60 wt.%, while the concentration of the sublimable dye contained in the dye supplying layer is preferably in the range of 5 wt.% to 80 wt.%. In order to make a dye concentration gradient between the image transfer facilitating layer and the dye supplying layer, the dye concentration in the dye supplying layer is preferably 1.1 to 5 times, more preferably 1.5 to 3 times, the dye concentration in the image transfer facilitating layer.

The materials for the support of the recording medium according to the present invention are, for example, films such as condenser paper, polyester film, polystyrene film, polysulfone film, polyimide film, and polyamide film.

A conventional adhesive layer may be interposed between the support and the dye supplying layer.

Furthermore, in order to prevent the recording medium from sticking to a thermal head when thermal recording is performed, it is preferable that the support be backed by a heat-resistant lubricating layer, which is formed on the opposite side to the dye supplying layer with respect to the support. It is preferable that the heat-resistant lubricating layer comprises as the main component a polysiloxane graft polymer. In this case, an aromatic polyamide film is preferably employed as the support.

The aromatic polyamide film is a condensation product between (i) an aromatic dicarboxylic acid such as phthalic acid or a derivative thereof, and (ii) an aromatic diamine such as phenylene diamine or a derivative thereof, as disclosed in Japanese Laid-Open Patent Applications 60-174694 and 61-86288. For use in practice, "TX Film" (trademark) available from Toray Industries, Inc. can be used as the aromatic polyamide film. The thickness of the film is preferably 3 to 10 μm.

The previously mentioned polysiloxane graft polymer for use in the heat-resistant lubricating layer is a polymer prepared as follows:

A mixture of monomers containing a polymerizable silane compound is subjected to a solution polymerization in the presence of polysiloxane having a terminal hydroxyl group.

A compound having the following formula is employed in the above polymerization as the polysiloxane having a terminal hydroxyl group:

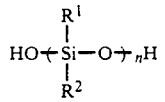

wherein $R^1$ and $R^2$ each independently represent an unsubstituted hydrocarbon group or a hydrocarbon group substituted with a monovalent halogen, and n represents an integer of 1 or more.

As the polymerizable silane compound, there is employed a compound containing at least one polymerizable unsaturated group and at least one group which can be condensed with the above-described polysiloxane having a terminal hydroxyl group. Examples of such compounds include vinyltrimethoxysilane, vinyltriethoxylsilane, vinyltributoxysilane, vinyltris(β-methoxyethoxy)silane, allyltriethoxysilane, γ-(metha)acryloylmethyl diethoxysilane, γ-(metha)acryloxypropyl tris(β-methoxyethoxy)silane, 2-styrylethyl trimethoxysilane, (metha)acryloxyethyldimethyl(3-trimethoxysilylpropyl)ammonium chloride, vinyltriacetoxysilane and vinyltrichlorosilane. These compounds can be employed either singly or in combination.

The above compound or a mixture of two or more of the above compounds is subjected to a solution polymerization together with an unsaturated organic acid such as acrylic acid, methacrylic acid, maleic acid or itaconic acid, and polymerizable monomers such as of acrylate. This polymerization is conducted in the manner disclosed in Japanese Laid-Open Patent Application 61-200111 or 61-215629.

In the heat-resistant lubricating layer comprising the above polysiloxane graft polymer, organic or inorganic finely-divided particles, and a lubricant can also be incorporated.

The organic or inorganic finely-divided particles for use in the heat-resistant lubricating layer are not limited in material. Examples of the material for the finely-divided particles include silica, alumina, titanium oxide, zinc oxide, calcium carbonate, aluminum carbonate, boron nitride, cobalt stearate, carbon fluoride, ethylene fluoride resin, polyimide resin, silicone, polystyrene, hardening polymer beads, and metals.

Examples of the lubricant include silicone oil, waxes and surface active agents.

It is preferable to incorporate, the finely-divided particles and the lubricant into the heat-resistant lubricating layer in a total amount of 0.1 to 100 parts by weight per 100 parts by weight of the polysiloxane graft polymer.

Furthermore, the diameter of the finely-divided particle is preferably 3 μm or less when the image quality is taken into consideration.

The siloxane graft polymer and the finely-divided particles are well mixed and dispersed in a proper solvent. The resulting dispersion is then coated onto an aromatic polyamide film serving as a support by means of wire bar coating, air knife coating, roller coating, gravure coating or screen coating. The thickness of the above dispersion is generally 0.1 to 8 μm, preferably 0.3 to 3 μm, when the heat-resistance and lubricating property are taken into consideration.

A heat-resistant lubricating layer comprising other resin can be formed in the following manner. A dispersion containing as its main component a polymeric binder component having high heat resistance and, if necessary, a filler and a lubricant is coated onto the support by a wire bar or a gravure coater, and then dried. The thickness of the layer is generally 0.1 to 10 μm, preferably 0.5 to 5 μm.

Examples of the polymeric binder include cellulose resin, silicone resin, fluorocarbon resin, phenol resin, butyral resin, epoxy resin, acryl resin, and copolymers thereof. These binders can be used either singly or in combination. In order to improve the heat resistance, a catalyst, a hardening agent or a cross-linking agent may be used together with the above binder resins.

As the filler, inorganic fine powders such as of silica, calcium carbonate and titanium dioxide, organic fine powders such as of Teflon, silicone and styrene, and metallic fine powders can be employed; and silicone oil, waxes and surface active agents can be used as the lubricant.

The plasticizers for use in the dye supplying layer, previously mentioned in the practice (c) in the method (2), are defined as such materials that come between the molecules of a resin and reduce the van der Waals' forces between the molecules by which the hard network structure of the resin is formed, and consequently decreasing the second order transition temperature of the resin. Further the term "compatibility" is defined as both the plasticizer and the resin having affinity for each other, with high gelation rate, and the plasticizer not being separated from the resin.

Plasticizers and resins for use in the present invention can be selected as desired, with the compatibility thereof taken into consideration, from those described in various publications, catalogs and references, for example, "Plastic Ingredients", page 17-, by Sakura Yamada, published by Taiseisha Co., Ltd. and "Chemical Products of 1988", page 745-, published by Kagaku Kogyo Niopposha, Co., Ltd.

Specific examples of the combinations of plasticizers, compatible resins, and non-compatible resins are as follows, in which the plasticizers and compatible resins are used in the dye supplying layer, while the non-compatible resins are employed in the image transfer facilitating layer.

| Plasticiers | Compatible Resins | Non-compatible Resins |
|---|---|---|
| Tricresyl phosphate | Acetylcellulose<br>Acetylbutylcellulose<br>Ethylcellulose<br>Acrylic resin<br>Acetylbutyl resin<br>Butyral resin | Polyvinylidene chloride<br>Polyamide |
| Tri-2-ethyl hexyl-phosphate | Nitrocellulose<br>Ethylcellulose<br>Butyral resin<br>Vinyl chloride resin | Acetylcellulose<br>Acetylbutylcellulose<br>Vinyl acetate resin |
| Triphenyl phosphate | Acetylcellulose<br>Ethylcellulose<br>Vinyl acetate resin | Butyral resin<br>Polyamide |
| Di-2-ethyl hexyl-phthalate | Acetylbutylcellulose<br>Ethylcellulose<br>Bytyral resin<br>Vinyl chloride resin<br>Nitrocellulose | Acetylcellulose<br>Vinyl acetate resin<br>Polyamide |
| Diisodecyl phthalate | Acetylbutylcellulose<br>Nitrocellulose<br>Ethylcellulose<br>Butyral resin | Acetylcellulose<br>Polyvinyl acetate |
| Ditridecyl phthalate | Vinyl acetate resin<br>Vinyl chloride resin | Acetylcellulose<br>Acetylbutylcellulose<br>Ethylcellulose<br>Butyral resin |

The above listed plasticizers are particularly preferable for use in the present invention because they are excellent in heat resistance and volatility.

The ratio of the added amount of the plasticizers to the amount of the resins is preferably 10 to 100 wt.%, more preferably 10 to 50 wt.%.

In the recording medium explained so far, the ink layer is divided into two layers which are the dye supplying layer and the image transfer facilitating layer. The ink layer can be into more than two layers as long as the separated functions intended in the present invention are attained, with appropriate differences in the amount of the dyes transferred therebetween.

In the present invention, thermal image transfer may be carried out by use of a thermal head, by laser beams, using a support which absorb laser beams and generates heat therefrom, or by causing an electric current to flow through the support and/or an ink-containing layer formed thereon so as to generate Joule's heat therein, that is, by the so-called electrothermic non-impact printing. The electrothermic non-impact printing method is described in many references, such as U.S. Pat. No. 4,103,066, Japanese Laid-Open Patent Applications 57-14060, 57-11080 and 59-9096.

When the electrothermic non-impact printing method is employed, as the support for the thermosensitive image transfer recording medium according to the present invention, supports which are modified to have an intermediate electric resistivity between the electric resistivities of an electroconductive material and an insulating material, for example, by dispersing finely-divided electroconductive particles, such as finely-divided metal particles of aluminum, copper, iron, tin, zinc, nickel, molybudenum, and silver, and/or carbon black, in a resin having relatively high heat resistance, such as polyester, polycarbonate, triacetylcellulose, nylon, polyimide, and aromatic polyamides, or by using a support of the above-mentioned resins, with the above-mentioned electroconductive metals deposited thereon by vacuum deposition or sputtering.

It is preferable that the thickness of such supports be in the range of about 2 μm to about 15 μm, when the thermal conductivity thereof for the generated Joule's heat is taken into consideration.

When laser beams are employed for image transfer, it is preferable that the support absorb laser beams and generates heat. For this purpose, for example, a support comprising a conventional thermal transfer film with addition thereto a material which absorbs heat and convert the light into heat, such as carbon black, may be employed. Alternatively, a light-absorbing and heat-generating layer may be laminated on the front and/or back side of the support.

Since the dye exists in the dye supplying layer in the form of undissolved granules, the ink layer tends to have a rough surface, resulting in uneven contact between the ink layer and an image receiving sheet.

At a portion where the ink layer and the image receiving sheet are not in close contact with each other, the dye cannot diffuse properly due to the presence of air therebetween, so that proper image transfer is impossible. When the dye is inadequately transferred to the image receiving sheet, the printed image density becomes low. It is considered that the recording sensitivity (printed image density) at the first printing ($n=1$) is different from those of the subsequent printings ($n \geqq 2$) because of the above mechanism, where "n" denotes the number of printings.

The inventors of the present invention have found that when the ink layer has a surface-roughness of $Ra \leqq 1.0$ μm, wherein "Ra" denotes an average center-line-roughness, the recording sensitivity does not change depending on the number of printings.

In the case of the ink layer consisting of two layers, having a roughness of $Ra > 1.0$ μm, the recording sensitivity does not change depending on the number of printings only when $Sm \leqq 10$ μm, wherein "Sm" denotes a mean space between the irregularities on the surface of the ink layer.

The above Ra and Sm are each measured in the method according to Japanese Industrial Standards (JIS) B0601.

As long as Ra and Sm of the ink layer-surface fall within each of the above ranges, the dye contained in the ink layer can be adequately transferred to the image receiving layer, even when $n \geqq 2$, with the aid of the heat applied by a thermal head, and/or the pressure applied by a platen roller or a thermal head.

Figure 2:
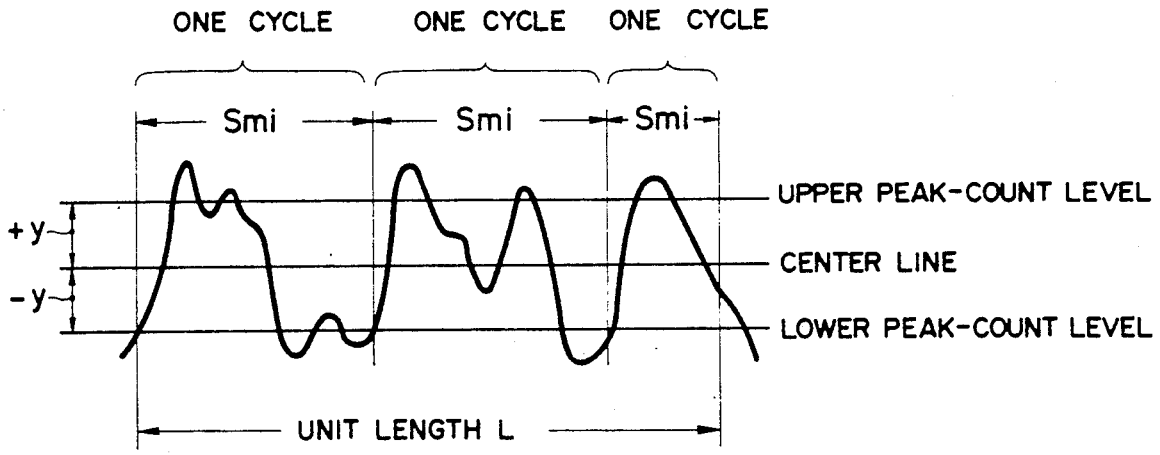
FIG. 2 is a diagram explaining the definition of the mean space Sm of unevenness of the surface of the ink layer.
Figure 3:
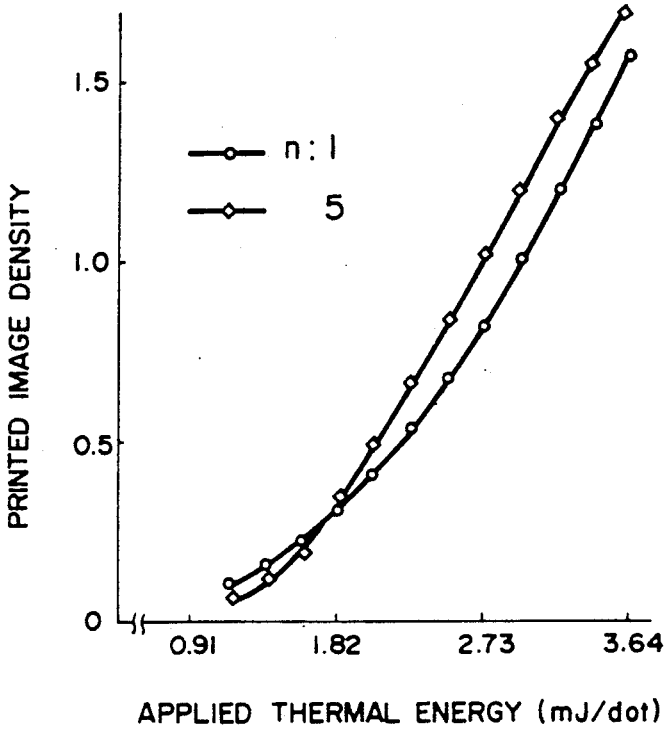
FIG. 3 is a graph showing the relationship between the printed image density (reflected image density) and the applied thermal energy obtained by the sublimation type thermosensitive image transfer recording medium No. 1-1 according to the present invention prepared in Example 1-1.
Figure 4:
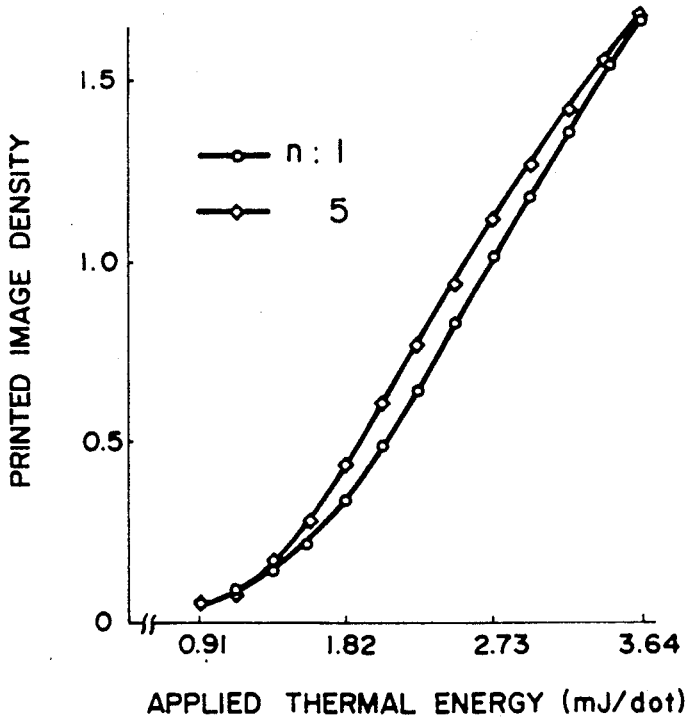
FIG. 4 is a graph showing the relationship between the printed image density (reflected image density) and the applied thermal energy obtained by the sublimation type thermosensitive image transfer recording medium No. 1-2 according to the present invention prepared in Example 1-2.
Figure 5:
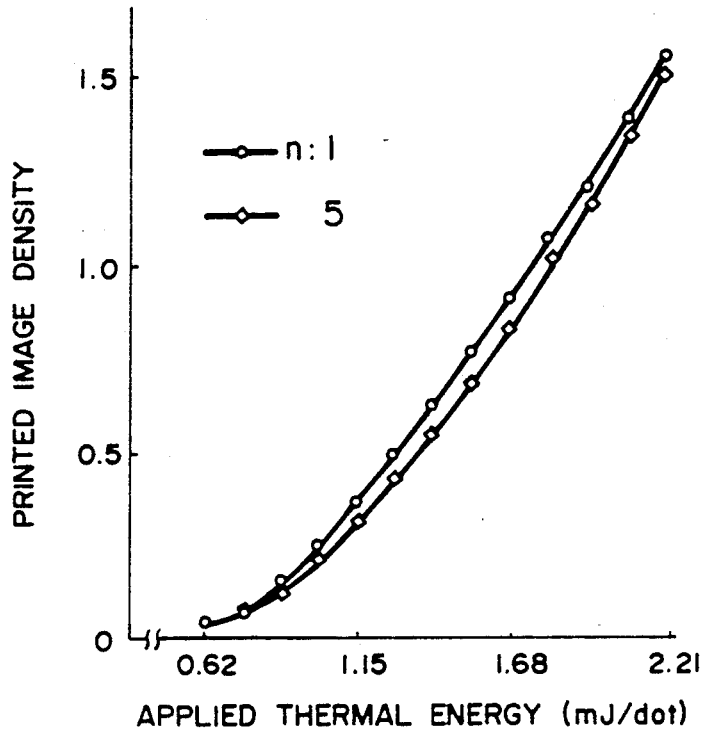
FIG. 5 is a graph showing the relationship between the printed image density (reflected image density) and the applied thermal energy obtained by the sublimation type thermosensitive image transfer recording medium No. 1-3 according to the present invention prepared in Example 1-3.
Figure 6:
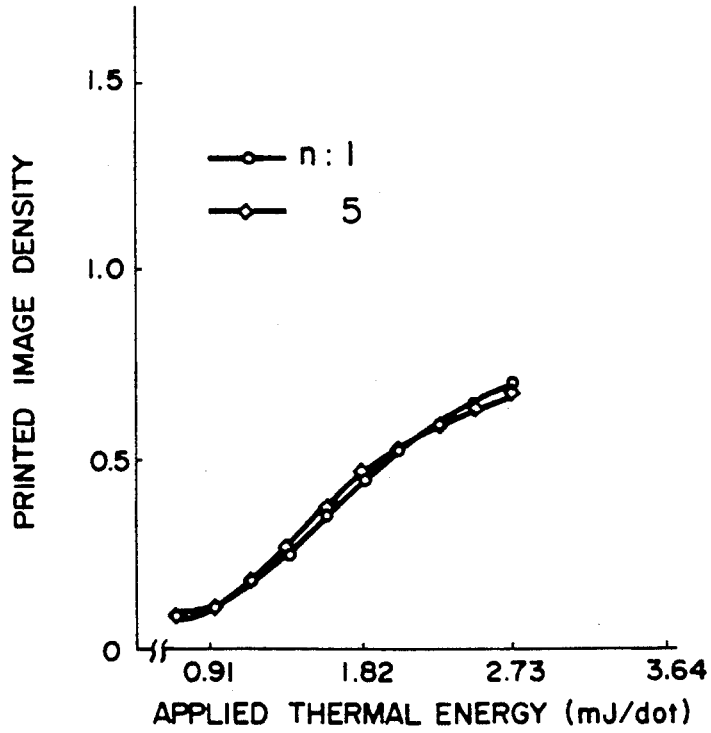
FIG. 6 is a graph showing the relationship between the printed image density (reflected image density) and the applied thermal energy obtained by the sublimation type thermosensitive image transfer recording medium No. 1-4 according to the present invention prepared in Example 1-4.
Figure 7:
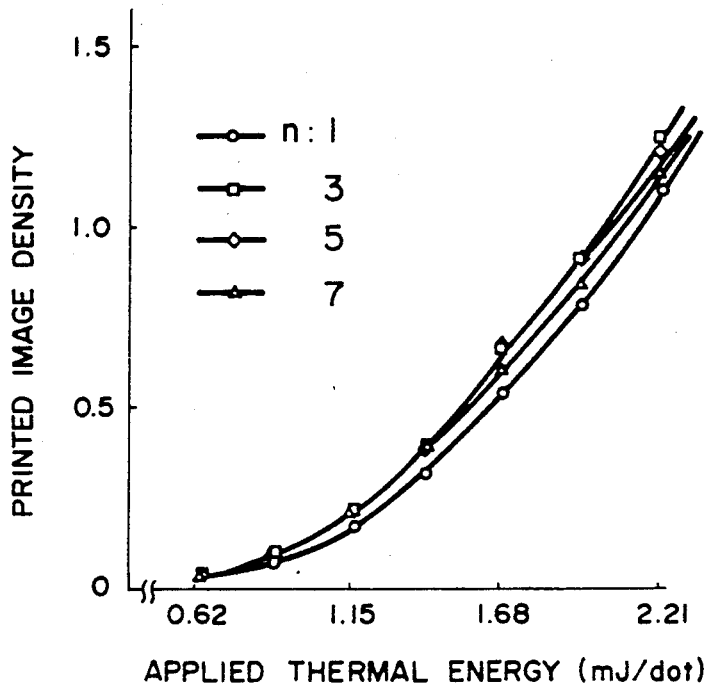
FIG. 7 is a graph showing the relationship between the printed image density (reflected image density) and the applied thermal energy obtained by the sublimation type thermosensitive image transfer recording medium No. 1-5 according to the present invention prepared in Example 1-5.
Figure 8:
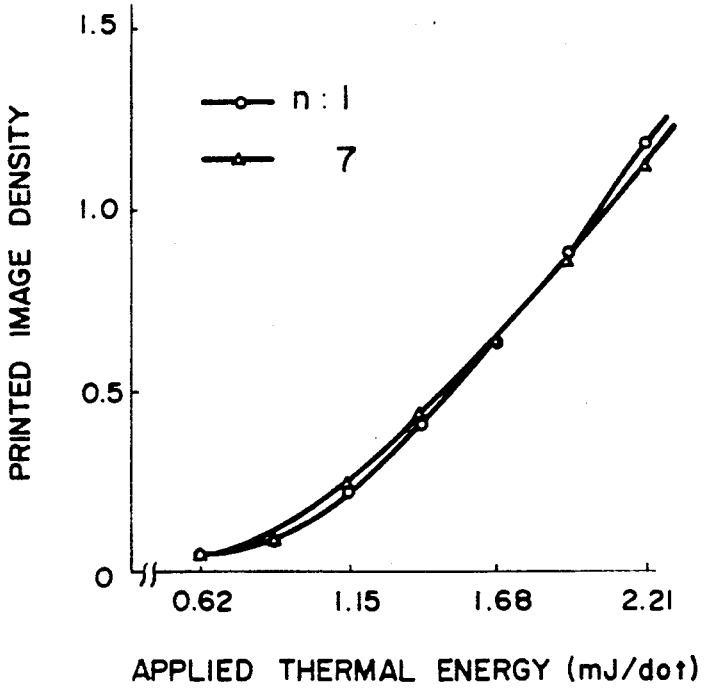
FIG. 8 is a graph showing the relationship between the printed image density (reflected image density) and the applied thermal energy obtained by the sublimation type thermosensitive image transfer recording medium No. 1-6 according to the present invention prepared in Example 1-6.

The definition of "Sm" is as follows. As shown in FIG. 2, two peak-count levels are drawn parallel to the center line of the roughness-curve obtained in accordance with JIS B0601. One cycle of the curve, which is indicated by "Smi" in FIG. 2, includes at least one point at which the roughness-curve crosses the upper peak-count level between the two points at which the roughness-curve crosses the lower peak-count level.

The peak-count level is determined to be 1.0 μm because excellent multiple recording characteristics free from the differences in the recording sensitivity can be obtained when $Ra \leqq 1.0$ μm.

The mean space between irregularities "Sm" can be calculated from the following equation:

$$Sm = \frac{1}{n} \sum_{n=1}^{n} Smi$$

where Smi represents the length of one cycle of the roughness-curve, and n represents the number of the cycles in a unit length; or $$Sm = L/n$$

where L represents the unit length.

An ink layer having a surface of the preferred smoothness ($Ra \leqq 1.0$ μm or $Sm \leqq 10$ μm) can readily be obtained by controlling the particle size of the dye which exists in the form of undissolved granules in the dye supplying layer, or pressing the dye supplying layer having a rough surface by a metallic roller or the like.

According to the thermosensitive recording method of the present invention, the above-described sublimation type thermosensitive image transfer recording medium is superimposed on a receiving sheet. Then heat is applied imagewise to the recording medium so that the sublimable dye can transfer imagewise from the recording medium to the receiving sheet. During the recording, the recording medium and the receiving sheet are moved at an equal speed or moved in such a manner that the running speed of the recording medium is smaller than that of the receiving sheet.

The features of this invention will become apparent in the course of the following description of exemplary embodiments which are given for illustration of the invention and are not intended to be limiting thereof.

EXAMPLE 1

-1

Preparation of Dye Supplying Layer

A mixture of the following components was dispersed in a ball mill for 24 hours, whereby a dye supplying layer coating dispersion No. 1-1 was prepared:

| | Parts by Weight |
|---|---|
| Polyvinyl butyral resin (Trademark "BX-1" made by Sekisui Chemical Co., Ltd., having a glass transition temperature of ca. 83° C.) | 1 |
| Polyethylene oxide (Trademark "Alkox R400" made by Meisei Chemical Works, Ltd., having a glass transition temperature of ca. −60° C.) | 9 |
| Sublimable dye | 10 |

-continued

| | Parts by Weight |
|---|---|
| (Trademark "Kayaset Blue 714" made by Nippon Kayaku Co., Ltd.) | |
| Solvents: Methanol | 171 |
| Ethanol | 17.1 |
| Butanol | 1.9 |

Preparation of Image Transfer Facilitating Layer

A mixture of the following components was dispersed in a ball mill for 24 hours, whereby an image transfer facilitating layer coating dispersion No. 1-1 was prepared:

| | Parts by Weight |
|---|---|
| Polyvinyl butyral resin (Trademark "BX-1" made by Sekisui Chemical Co., Ltd.) | 10 |
| Sublimable dye (Trademark "Kayaset Blue 714" made by Nippon Kayaku Co., Ltd.) | 7.5 |
| Solvents: Toluene | 95 |
| Methyl ethyl ketone | 95 |

The dye supplying layer coating dispersion No. 1-1 was coated by a wire bar on a polyimide film having a thickness of 8.5 μm (made by Toray-DuPont Co., Ltd.) serving as a support 1 as illustrated in FIG. 1, whereby a dye supplying layer 4 having a thickness of 4.5 μm when dried was formed on the support 1. Subsequently, the image transfer facilitating layer coating dispersion No. 1-1 was coated by a wire bar on the dye supplying layer 4 and dried, whereby an image transfer facilitating layer 5 having a thickness of 1.0 μm when dried was formed on the dye supplying layer 4, thus a sublimation type thermosensitive image transfer recording medium No. 1-1 according to the present invention was prepared.

The above dye supplying layer was observed by a scan type electron microscope S-310A (made by Hitachi, Ltd.) when it was formed. It was found in the 2000-time magnified sample that the undissolved granular dye existed as crystals in the form of needles having an average diameter (longer direction) of approximately 7.0 μm, and a large number of these crystals were mingled one another.

EXAMPLE 1

-2

Preparation of Dye Supplying Layer

A mixture of the following components was dispersed in a ball mill for 24 hours, whereby a dye supplying layer coating dispersion No. 1-2 was prepared:

| | Parts by Weight |
|---|---|
| Polyvinyl butyral resin (Trademark "BX-1" made by Sekisui Chemical Co., Ltd., having a glass transition temperature of ca. 83° C.) | 1 |
| Polyethylene oxide (Trademark "Alkox R400" made by Meisei Chemical Works, Ltd., having a glass transition temperature of ca. −60° C.) | 9 |
| Sublimable dye (Trademark "Kayaset Blue 714" made by Nippon Kayaku Co., Ltd.) | 10 |
| Solvents: Toluene | 95 |
| Methyl ethyl ketone | 95 |

The dye supplying layer coating dispersion No. 1-2 was coated by a wire bar on a polyimide film having a thickness of 8.5 μm (made by Toray-DuPont Co., Ltd.) serving as a support, whereby a dye supplying layer having a thickness of 4.5 μm when dried was formed on the support. Subsequently, the image transfer facilitating layer coating dispersion No. 1-1 prepared in Example 1-1 was coated by a wire bar on the dye supplying layer and dried, whereby an image transfer facilitating layer having a thickness of 1.0 μm when dried was formed on the dye supplying layer, thus a sublimation type thermosensitive image transfer recording medium No. 1-2 according to the present invention was prepared.

The above dye supplying layer was subjected to the same microscopic observation as in Example 1-1 when it was formed. As a result, a large number of crystals in the form of needles were found, and the presence of the dye in the form of undissolved granules was thus confirmed.

EXAMPLE 1

-3

Preparation of Image Transfer Facilitating Layer

A mixture of the following components was dispersed in a ball mill for 24 hours, whereby an image transfer facilitating layer coating dispersion No. 1-2 was prepared:

| | Parts by Weight |
|---|---|
| Ethyl cellulose | 10 |
| Sublimable dye (Trademark "Kayaset Blue 714" made by Nippon Kayaku Co., Ltd.) | 7.5 |
| Solvents: Toluene | 95 |
| Methyl ethyl ketone | 95 |

Preparation of Dye Supplying Layer

A mixture of the following components was dispersed in a ball mill for 24 hours, whereby a dye supplying layer coating dispersion No. 1-3 was prepared:

| | Parts by Weight |
|---|---|
| Ethyl cellulose | 7 |
| Polyethylene oxide (Trademark "Alkox R400" made by Meisei Chemical Works, Ltd.) | 3 |
| Sublimable dye (Trademark "Kayaset Blue 714" made by Nippon Kayaku Co., Ltd.) | 10 |
| Solvent: Methanol | 190 |

The dye supplying layer coating dispersion No. 1-3 was coated by a wire bar on a polyimide film having a thickness of 8.5 μm (made by Toray-DuPont Co., Ltd.) serving as a support, whereby a dye supplying layer having a thickness of 4.5 μm when dried was formed on the support. Subsequently, the image transfer facilitating layer coating dispersion No. 1-2 was coated by a wire bar on the dye supplying layer and dried, whereby an image transfer facilitating layer having a thickness of 1.0 μm when dried was formed on the dye supplying layer, thus a sublimation type thermosensitive image transfer recording medium No. 1-3 according to the present invention was prepared.

The above dye supplying layer was subjected to the same microscopic observation as in Example 1-1 when it was formed. As a result, a large number of crystals in the form of needles were found, and the presence of the dye in the form of undissolved granules was thus confirmed.

EXAMPLE 1

-4

Preparation of Image Transfer Facilitating Layer

A mixture of the following components was dispersed in a ball mill for 24 hours, whereby an image transfer facilitating layer coating dispersion No. 1-3 was prepared:

| | Parts by Weight |
|---|---|
| Polyvinyl butyral resin (Trademark "BX-1" made by Sekisui Chemical Co., Ltd.) | 10 |
| Sublimable dye (Trademark "Macrolex Yellow 6G" made by Bayer A.G.) | 4 |
| Solvents: Ethanol | 128.25 |
| Toluene | 23.75 |
| Methyl ethyl ketone | 23.75 |
| Butanol | 14.25 |

Preparation of Dye Supplying Layer

A mixture of the following components was dispersed in a ball mill for 24 hours, whereby a dye supplying layer coating dispersion No. 1-4 was prepared:

| | Parts by Weight |
|---|---|
| Polyvinyl butyral resin (Trademark "BX-1" made by Sekisui Chemical Co., Ltd.) | 7 |
| Polyethylene oxide (Trademark "Alkox R400" made by Meisei Chemical Works, Ltd.) | 3 |
| Sublimable dye (Trademark "Macrolex Yellow 6G" made by Bayer A.G.) | 4 |
| Solvents: Methanol | 171 |
| Ethanol | 17.1 |
| Butanol | 1.9 |

The dye supplying layer coating dispersion No. 1-4 was coated by a wire bar on a polyimide film having a thickness of 8.5 μm (made by Toray-DuPont Co., Ltd.) serving as a support, whereby a dye supplying layer having a thickness of 5.0 μm when dried was formed on the support. Subsequently, the image transfer facilitating layer coating dispersion No. 1-3 was coated by a wire bar on the dye supplying layer and dried, whereby an image transfer facilitating layer having a thickness of 0.8 μm when dried was formed on the dye supplying layer, thus a sublimation type thermosensitive image transfer recording medium No. 1-4 according to the present invention was prepared.

The above dye supplying layer was subjected to the same microscopic observation as in Example 1-1 when it was formed. As a result, a large number of crystals in the form of needles were found, and the presence of the dye in the form of undissolved granules was thus confirmed.

EXAMPLE 1

-5

Preparation of Heat-resistant Lubricating Layer

A dispersion having the following formulation was prepared.

| | Parts by Weight |
|---|---|
| Methylmethacrylate | 10 |
| n-Butylacrylate | 2 |
| Benzoyl peroxide | 0.1 |
| Silica | 2.5 |
| Toluene | 35 |
| Isopropyl alcohol | 15 |

The above-prepared dispersion was coated onto an aromatic polyamide film (Trademark "TX-I", made by Toray Industries, Inc.) having a thickness of approximately 6.0 μm, which serves as a support, by using a wire bar, and dried. Thus a heat-resistant lubricating layer having a thickness of approximately 1.0 μm was formed on the support.

Thereafter, Example 1-1 was repeated except that the support employed in Example 1-1 was replaced by the above-prepared support which was backed by the heat-resistant lubricating layer, whereby a sublimation type thermosensitive image transfer recording medium No. 1-5 was prepared.

The dye supplying layer was subjected to the same microscopic observation as in Example 1-1 when it was formed. As a result, a large number of crystals in the form of needles were found, and the presence of the dye in the form of undissolved granules was thus confirmed.

EXAMPLE 1

-6

Preparation of Heat-resistant Lubricating Layer

A dispersion having the following formulation was prepared.

| | Parts by Weight |
|---|---|
| Silicone resin solution (Trademark "SD7223" made by Toray Silicone Co., Ltd, Solid content: 30%) | 30 |
| Hardening agent (Trademark "SRX-212" made by Toray Silicone Co., Ltd.) | 0.27 |
| Silica | 2.5 |
| Toluene | 70 |
| n-Hexane | 30 |

The above-prepared dispersion was coated onto an aromatic polyamide film (Trademark "TX-I", made by Toray Industries, Inc.) having a thickness of approximately 6.0 μm, which serves as a support, by using a wire bar, and dried. Thus a heat-resistant releasing layer having a thickness of approximately 1.0 μm was formed on the support.

Thereafter, Example 1-2 was repeated except that the support employed in Example 1-2 was replaced by the above-prepared support which was backed by the heat-resistant lubricating layer, whereby a sublimation type thermosensitive image transfer recording medium No. 1-6 was prepared.

The dye supplying layer was subjected to the same microscopic observation as in Example 1-1 when it was formed. As a result, a large number of crystals in the form of needles were found, and the presence of the dye in the form of undissolved granules was thus confirmed.

The above prepared sublimation type thermosensitive image transfer recording media Nos. 1-1 through 1-6 according to the present invention were subjected to a thermal recording test, using a thermal head 6 as shown in FIG. 1. In this recording test, images were printed repeatedly from an identical spot of each recording medium onto an image receiving sheet 3 which is commercially available as an image receiving sheet with a trademark of "Supply VY-S100" for "Hitachi Video Printer VY-50". In the above, the applied power was 455 mW/dot, and the printed image density was measured by a Macbeth Densitometer RD-514. Thus, the relationship between the applied thermal energy E (mJ/dot) and the printed image density of each recording medium was investigated. The results are shown in the graphs of FIGS. 3 to 8.

The initially obtained printed image density was unchanged even after the multiple printing as shown in the graphs, and good gradation in the printed images was obtained.

Especially, the recording media Nos. 1-5 and 1-6, which have the support made of an aromatic polyamide film provided with the heat-resistant lubricating layer, were completely free from the problem referred to as "sticking".

EXAMPLE 2

-1

Preparation of Dye Supplying Layer

A mixture of the following components was dispersed in a ball mill for 24 hours, whereby a dye supplying layer coating dispersion No. 2-1 was prepared:

| | Parts by Weight |
|---|---|
| Polyvinyl butyral resin (Trademark "BX-1" made by Sekisui Chemical Co., Ltd.) | 3 |
| Polyethylene oxide (Trademark "Alkox R400" made by Meisei Chemical Works, Ltd.) | 7 |
| Sublimable dye (Trademark "Kayaset Blue 714" made by Nippon Kayaku Co., Ltd.) | 15 |
| Solvents: Toluene | 95 |
| Methyl ethyl ketone | 95 |

Preparation of Image Transfer Facilitating Layer

A mixture of the following components was dispersed in a ball mill for 24 hours, whereby an image transfer facilitating layer coating dispersion No. 2-1 was prepared:

| | Parts by Weight |
|---|---|
| Polyvinyl butyral resin (Trademark "BX-1" made by Sekisui Chemical Co., Ltd.) | 10 |
| Sublimable dye (Trademark "Kayaset Blue 714" made by Nippon Kayaku Co., Ltd.) | 7.5 |
| Solvents: Toluene | 95 |

-continued

| | Parts by Weight |
|---|---|
| Methyl ethyl ketone | 95 |

The dye supplying layer coating dispersion No. 2-1 was coated by a wire bar on a polyimide film having a thickness of 8.0 μm (made by Toray-DuPont Co., Ltd.) serving as a support, whereby a dye supplying layer having a thickness of 4.5 μm when dried was formed on the support. Subsequently, the image transfer facilitating layer coating dispersion No. 2-1 was coated by a wire bar on the dye supplying layer and dried, whereby an image transfer facilitating layer having a thickness of 0.8 μm when dried was formed on the dye supplying layer. Thus, an ink layer was formed on the support.

The above-obtained thermal image transfer sheet was super-calendered 4 times under a load of 10 kg/cm$^2$, whereby a sublimation type thermosensitive image transfer recording medium No. 2-1 according to the present invention, with the surface of the ink layer having an average center-line-roughness Ra of 0.534 μm, was prepared.

The above dye supplying layer was observed by a scan type electron microscope S-310A (made by Hitachi, Ltd.) when it was formed. It was found in the 2000-time magnified sample that the undissolved granular dye existed as crystals in the form of needles having an average diameter (longer direction) of approximately 7.0 μm, and a large number of these crystals were mingled one another.

EXAMPLE 2

-2

Preparation of Dye Supplying Layer

A mixture of the following components was dispersed in a ball mill for 24 hours, whereby a dye supplying layer coating dispersion No. 2-2 was prepared:

| | Parts by Weight |
|---|---|
| Polyvinyl butyral resin (Trademark "BX-1" made by Sekisui Chemical Co., Ltd.) | 3 |
| Polyethylene oxide (Trademark "Alkox R400" made by Meisei Chemical Works, Ltd.) | 3 |
| Sublimable dye (Trademark "MS Red G" made by Mitsui Toatsu Chemicals, Inc.) | 20 |
| Sublimable dye (Trademark "Macrolex Red Violet R" made by Bayer A.G.) | 20 |
| Solvents: Toluene | 10 |
| Methyl ethyl ketone | 60 |
| | 60 |

Preparation of Image Transfer Facilitating Layer

A mixture of the following components was dispersed in a ball mill for 24 hours, whereby an image transfer facilitating layer coating dispersion No. 2-2 was prepared:

| | Parts by Weight |
|---|---|
| Polyvinyl butyral resin (Trademark "BX-1" made by Sekisui Chemical Co., Ltd.) | 4 |
| Sublimable dye (Trademark "MS Red G" made by | 2 |

-continued

| | Parts by Weight |
|---|---|
| Mitsui Toatsu Chemicals, Inc.) | |
| Sublimable dye | 1 |
| (Trademark "Macrolex Red Violet R" made by Bayer A.G.) | |
| Solvents: Toluene | 40 |
| Methyl ethyl ketone | 40 |

The dye supplying layer coating dispersion No. 2-2 was coated by a wire bar on a polyimide film having a thickness of 8.0 μm (made by Toray-DuPont Co., Ltd.) serving as a support, whereby a dye supplying layer having a thickness of 4.5 μm when dried was formed on the support. Subsequently, the image transfer facilitating layer coating dispersion No. 2-2 was coated by a wire bar on the dye supplying layer and dried, whereby an image transfer facilitating layer having a thickness of 0.8 μm when dried was formed on the dye supplying layer. Thus, an ink layer was formed on the support.

The above-obtained thermal image transfer sheet was super-calendered 4 times under a load of 10 kg/cm$^2$, whereby a sublimation type thermosensitive image transfer recording medium No. 2-2 according to the present invention, with the surface of the ink layer having an average center-line-roughness Ra of 0.543 μm, was prepared.

The above dye supplying layer was subjected to the same microscopic observation as in Example 2-1 when it was formed. As a result, a large number of crystals in the form of needles were found, and the presence of the dye in the form of undissolved granules was thus confirmed.

EXAMPLE 2

-3

Preparation of Dye Supplying Layer

A mixture of the following components was dispersed in a ball mill for 24 hours, whereby a dye supplying layer coating dispersion No. 2-3 was prepared:

| | Parts by Weight |
|---|---|
| Polyvinyl butyral resin (Trademark "BX-1" made by Sekisui Chemical Co., Ltd.) | 5 |
| Polyethylene oxide (Trademark "Alkox R400" made by Meisei Chemical Works, Ltd.) | 3 |
| Sublimable dye (Trademark "Macrolex Yellow 6G" made by Bayer A.G.) | 8 |
| Solvents: Ethanol | 144 |
| Butanol | 16 |

Preparation of Image Transfer Facilitating Layer

A mixture of the following components was dispersed in a ball mill for 24 hours, whereby an image transfer facilitating layer coating dispersion No. 2-3 was prepared:

| | Parts by Weight |
|---|---|
| Polyvinyl butyral resin (Trademark "BX-1" made by Sekisui Chemical Co., Ltd.) | 5 |
| Sublimable dye (Trademark "Macrolex Yellow 6G" made by Bayer A.G.) | 2 |
| Solvents: Toluene | 15 |
| Methyl ethyl ketone | 15 |
| Ethanol | 63 |
| Butanol | 7 |

The dye supplying layer coating dispersion No. 2-3 was coated by a wire bar on a polyimide film having a thickness of 8.0 μm (made by Toray-DuPont Co., Ltd.) serving as a support, whereby a dye supplying layer having a thickness of 5.0 μm when dried was formed on the support. Subsequently, the image transfer facilitating layer coating dispersion No. 2-3 was coated by a wire bar on the dye supplying layer and dried, whereby an image transfer facilitating layer having a thickness of 0.8 μm when dried was formed on the dye supplying layer. Thus, an ink layer was formed on the support.

The above-obtained thermal image transfer sheet was super-calendered 4 times under a load of 10 kg/cm$^2$, whereby a sublimation type thermosensitive image transfer recording medium No. 2-3 according to the present invention, with the surface of the ink layer having an average center-line-roughness Ra of 0.742 μm, was prepared.

The above dye supplying layer was subjected to the same microscopic observation as in Example 2-1 when it was formed. As a result, a large number of crystals in the form of needles were found, and the presence of the dye in the form of undissolved granules was thus confirmed.

EXAMPLE 2

-4

Preparation of Dye Supplying Layer

A mixture of the following components was dispersed in a ball mill for 24 hours, whereby a dye supplying layer coating dispersion No. 2-4 was prepared:

| | Parts by Weight |
|---|---|
| Polyvinyl butyral resin (Trademark "BX-1" made by Sekisui Chemical Co., Ltd.) | 7 |
| Polyethylene oxide (Trademark "Alkox R400" made by Meisei Chemical Works, Ltd.) | 3 |
| Sublimable dye (Trademark "Kayaset Blue 714" made by Nippon Kayaku Co., Ltd.) | 15 |
| Solvents: Toluene | 95 |
| Methyl ethyl ketone | 95 |

Preparation of Image Transfer Facilitating Layer

A mixture of the following components was dispersed in a ball mill for 24 hours, whereby an image transfer facilitating layer coating dispersion No. 2-4 was prepared:

| | Parts by Weight |
|---|---|
| Polyvinyl butyral resin (Trademark "BX-1" made by Sekisui Chemical Co., Ltd.) | 10 |
| Sublimable dye (Trademark "Kayaset Blue 714" made by Nippon Kayaku Co., Ltd.) | 7.5 |

-continued

| | Parts by Weight |
|---|---|
| Solvents: Toluene | 95 |
| Methyl ethyl ketone | 95 |

The dye supplying layer coating dispersion No. 2-4 was coated by a gravure coater on a polyimide film having a thickness of 8.0 μm (made by Toray-DuPont Co., Ltd.) serving as a support, whereby a dye supplying layer having a thickness of 4.5 μm when dried was formed on the support. Subsequently, the image transfer facilitating layer coating dispersion No. 2-4 was coated by a gravure coater on the dye supplying layer and dried, whereby an image transfer facilitating layer having a thickness of 0.8 μm when dried was formed on the dye supplying layer. Thus, an ink layer was formed on the support, and a sublimation type thermosensitive image transfer recording medium No. 2-4 according to the present invention was obtained.

The smoothness of the ink layer of the above-obtained recording medium was measured. As a result, Ra and Sm of the recording medium were 1.844 μm and 7.149 μm, respectively.

The above dye supplying layer was subjected to the same microscopic observation as in Example 2-1 when it was formed. As a result, a large number of crystals in the form of needles were found, and the presence of the dye in the form of undissolved granules was thus confirmed.

EXAMPLE 2

-5

Preparation of Dye Supplying Layer

A mixture of the following components was dispersed in a ball mill for 24 hours, whereby a dye supplying layer coating dispersion No. 2-5 was prepared:

| | Parts by Weight |
|---|---|
| Polyvinyl butyral resin (Trademark "BX-1" made by Sekisui Chemical Co., Ltd.) | 3 |
| Polyethylene oxide (Trademark "Alkox R400" made by Meisei Chemical Works, Ltd.) | 3 |
| Sublimable dye (Trademark "MS Red G" made by Mitsui Toatsu Chemicals Inc.) | 20 |
| Sublimable dye (Trademark "Macrolex Red Violet R" made by Bayer A.G.) | 10 |
| Solvents: Toluene | 60 |
| Methyl ethyl ketone | 60 |

Preparation of Image Transfer Facilitating Layer

A mixture of the following components was dispersed in a ball mill for 24 hours, whereby an image transfer facilitating layer coating dispersion No. 2-5 was prepared:

| | Parts by Weight |
|---|---|
| Polyvinyl butyral resin (Trademark "BX-1" made by Sekisui Chemical Co., Ltd.) | 4 |
| Sublimable dye (Trademark "MS Red G" made by Mitsui Toatsu Chemicals Inc. | 2 |

-continued

| | Parts by Weight |
|---|---|
| Sublimable dye (Trademark "Macrolex Red Violet R" made by Bayer A.G.) | 1 |
| Solvents: Toluene | 40 |
| Methyl ethyl ketone | 40 |

The dye supplying layer coating dispersion No. 2-5 was coated by a gravure coater on a polyimide film having a thickness of 8.0 μm (made by Toray-DuPont Co., Ltd.) serving as a support, whereby a dye supplying layer having a thickness of 4.5 μm when dried was formed on the support. Subsequently, the image transfer facilitating layer coating dispersion No. 2-5 was coated by a gravure coater on the dye supplying layer and dried, whereby an image transfer facilitating layer having a thickness of 0.8 μm when dried was formed on the dye supplying layer. Thus, an ink layer was formed on the support, and a sublimation type thermosensitive image transfer recording medium No. 2-5 according to the present invention was prepared.

The smoothness of the ink layer of the above-obtained recording medium was measured. As a result, Ra and Sm of the recording medium were 1.646 μm and 8.04 μm, respectively.

The above dye supplying layer was subjected to the same microscopic observation as in Example 2-1 when it was formed. As a result, a large amount of crystals in the form of needles were found, and the presence of the dye in the form of undissolved granules was thus confirmed.

EXAMPLE 2

-6

Preparation of Dye Supplying Layer

A mixture of the following components was dispersed in a ball mill for 24 hours, whereby a dye supplying layer coating dispersion No. 2-6 was prepared:

| | Parts by Weight |
|---|---|
| Polyvinyl butyral resin (Trademark "BX-1" made by Sekisui Chemical Co., Ltd.) | 5 |
| Polyethylene oxide (Trademark "Alkox R400" made by Meisei Chemical Works, Ltd.) | 3 |
| Sublimable dye (Trademark "Macrolex Yellow 6G" made by Bayer A.G.) | 8 |
| Solvents: Ethanol | 144 |
| Butanol | 16 |

Preparation of Image Transfer Facilitating Layer

A mixture of the following components was dispersed in a ball mill for 24 hours, whereby an image transfer facilitating layer coating dispersion No. 2-6 was prepared:

| | Parts by Weight |
|---|---|
| Polyvinyl butyral resin (Trademark "BX-1" made by Sekisui Chemical Co., Ltd.) | 5 |
| Sublimable dye (Trademark "Macrolex Yellow 6G" made by Bayer A.G.) | 2 |

-continued

| | Parts by Weight |
|---|---|
| Solvents: Toluene | 15 |
| Methyl ethyl ketone | 15 |
| Ethanol | 63 |
| Butanol | 7 |

The dye supplying layer coating dispersion No. 2-6 was coated by a gravure coater on a polyimide film having a thickness of 8.0 μm (made by Toray-DuPont Co., Ltd.) serving as a support, whereby a dye supplying layer having a thickness of 5.0 μm when dried was formed on the support. Subsequently, the image transfer facilitating layer coating dispersion No. 2-6 was coated by a gravure coater on the dye supplying layer and dried, whereby an image transfer facilitating layer having a thickness of 0.8 μm when dried was formed on the dye supplying layer. Thus, an ink layer was formed on the support, and a sublimation type thermosensitive image transfer recording medium No. 2-6 according to the present invention was obtained.

The smoothness of the ink layer of the above-obtained recording medium was measured. As a result, Ra and Sm of the recording medium were 1.484 μm and 8.14 μm, respectively.

The above dye supplying layer was subjected to the same microscopic observation as in Example 2-1 when it was formed. As a result, a large number of crystals in the form of needles were found, and the presence of the dye in the form of undissolved granules was thus confirmed.

The above prepared sublimation type thermosensitive image transfer recording media Nos. 2-1 through 2-6 according to the present invention were subjected to a thermal recording test, using a thermal head 6. In this recording test, images were printed repeatedly from an identical spot of each recording medium onto an image receiving sheet 3 which is commercially available as an image receiving sheet with a trademark of "Supply VY-S100" for "Hitachi Video Printer VY-50". In the above, the applied power was 455 mW/dot, and the printed image density was measured by a Macbeth Densitometer RD-514. Thus, the relationship between the applied thermal energy E (mJ/dot) and the printed image density of each recording medium was investigated. The results are shown in Table 1.

TABLE 1

| Recording Medium | n = 1 | n = 2 | n = 3 | n = 4 | n = 5 | Change in Sensitivity | Printed Image Quality |
|---|---|---|---|---|---|---|---|
| No. 1 | 1.58 | 1.61 | 1.60 | 1.62 | 1.60 | none | good |
| No. 2 | 1.50 | 1.54 | 1.52 | 1.50 | 1.52 | none | good |
| No. 3 | 1.30 | 1.32 | 1.33 | 1.32 | 1.32 | none | good |
| No. 4 | 1.43 | 1.49 | 1.49 | 1.50 | 1.49 | none | good |
| No. 5 | 1.38 | 1.44 | 1.42 | 1.43 | 1.41 | none | good |
| No. 6 | 1.25 | 1.31 | 1.32 | 1.31 | 1.31 | none | good |

The data in the above table demonstrate that there were no changes in the image density obtained in first printing through fifth printing. Thus, the sublimation type thermosensitive image transfer recording media according to the present invention can give printed images of high quality, and can stand for multiple printing.

EXAMPLE 3

-1

Preparation of Dye Supplying Layer

A mixture of the following components was dispersed in a ball mill for 24 hours, whereby a dye supplying layer coating dispersion No. 3-1 was prepared:.

| | Parts by Weight |
|---|---|
| Polyvinyl butyral resin (Trademark "BX-1" made by Sekisui Chemical Co., Ltd.) | 10 |
| Sublimable dye (Trademark "Kayaset Blue 714" made by Nippon Kayaku Co., Ltd.) | 20 |
| Diisocyanate (Trademark "Coronate L" made by Nippon Polyurethane Industry Co., Ltd.) | 1 |
| Solvents: Toluene | 95 |
| Methyl ethyl ketone | 95 |

Preparation of Image Transfer Facilitating Layer

A mixture of the following components was dispersed in a ball mill for 24 hours, whereby an image transfer facilitating layer coating dispersion No. 3-1 was prepared:

| | Parts by Weight |
|---|---|
| Polyvinyl butyral resin (Trademark "BX-1" made by Sekisui Chemical Co., Ltd.) | 4 |
| Sublimable dye (Trademark "Kayaset Blue 714" made by Nippon Kayaku Co., Ltd.) | 3 |
| Solvents: Toluene | 38 |
| Methyl ethyl ketone | 38 |

The dye supplying layer coating dispersion No. 3-1 was coated by a wire bar on a polyimide film having a thickness of 8.5 μm (made by Toray-DuPont Co., Ltd.) serving as a support, whereby a dye supplying layer having a thickness of 4.5 μm when dried was formed on the support. Subsequently, the image transfer facilitating layer coating dispersion No. 3-1 was coated by a wire bar on the dye supplying layer and dried, whereby an image transfer facilitating layer having a thickness of 1.0 μm when dried was formed on the dye supplying layer. Thus, a sublimation type thermosensitive image transfer recording medium No. 3-1 according to the present invention was obtained.

The above dye supplying layer was observed by a scan type electron microscope S-310A (made by Hitachi, Ltd.) when it was formed. It was found in the 2000-time magnified sample that the undissolved granular dye existed as crystals in the form of needles having an average diameter (longer direction) of approximately 7.0 μm, and a large number of these crystals were mingled one another.

EXAMPLE 3

-2

Example 3-1 was repeated except that polyvinyl butyral resin "BX-1" employed in both the dye supplying layer and the image transfer facilitating layer was each replaced by "Denka Butyral 5000-A" (Trademark), commercially available from Denki Kagaku Kogyo K.K., whereby a sublimation type thermosensitive image transfer recording medium No. 3-2 according to the present invention was obtained.

The dye supplying layer was subjected to the same microscopic observation as in Example 3-1 when it was formed. As a result, a large number of crystals in the form of needles were found, and the presence of the dye in the form of undissolved granules was thus confirmed.

EXAMPLE 3

-3

Example 1 was repeated except that polyvinyl butyral resin "BX-1" employed in the dye supplying layer was replaced by polyvinyl butyral resin "BL-1" (trademark), commercially available from Sekisui Chemical Co., Ltd., whereby a sublimation type thermosensitive image transfer recording medium No. 3-3 according to the present invention was obtained.

The dye supplying layer was subjected to the same microscopic observation as in Example 3-1 when it was formed. As a result, a large number of crystals in the form of needles were found, and the presence of the dye in the form of undissolved granules was thus confirmed.

EXAMPLE 3

-4

Example 1 was repeated except that polyvinyl butyral resin "BX-1" employed in the dye supplying layer was replaced by polyether resin "SF Primer 725" (Trademark), commercially available from Dainippon Ink & Chemicals, Inc., and 95 parts by weight of toluene and 95 parts by weight of methyl ethyl ketone employed as the solvents in the dye supplying layer were replaced by 20 parts by weight of toluene, 20 parts by weight of ethylacetate and 10 parts by weight of isopropyl alcohol, whereby a sublimation type thermosensitive image transfer recording medium No. 3-4 according to the present invention was prepared.

The dye supplying layer was subjected to the same microscopic observation as in Example 3-1 when it was formed. As a result, a large number of crystals in the form of needles were found, and the presence of the dye in the form of undissolved granules was confirmed.

The above-prepared sublimation type thermosensitive image transfer recording media Nos. 3-1, 3-2, 3-3 and 3-4 according to the present invention were each subjected to a thermal recording test, using a thermal head 6. In this recording test, images were printed five times from an identical spot of each recording medium onto an image receiving sheet 3 which is commercially available as an image receiving sheet with a trademark of "Supply VY-S100" for "Hitachi Video Printer VY-50", under the printing conditions of an applied power of 455 mW/dot, and a maximum applied energy of 3.00 mJ/dot. The printed image density was measured by a Macbeth Densitometer RD-514. The results are shown in Table 2.

TABLE 2

| Recording Medium | Printed Image Density | Uniformity in Printed Images | Exfoliation of Ink Layer |
|---|---|---|---|
| No. 3-1 | good | good | none |
| No. 3-2 | good | good | none |
| No. 3-3 | good | good | none |
| No. 3-4 | good | good | none |

What is claimed is:

1. A sublimation type thermosensitive image transfer recording medium comprising:

a support, an ink layer formed on said support, which comprises (a) a dye supplying layer formed on said support, comprising a sublimable dye and a binder agent in which said sublimable dye is dispersed in the form of undissolved granules, and (b) an image transfer facilitating layer formed on said dye supplying layer, comprising the sublimable dye and a binder agent in which said sublimable dye is dissolved, said dye supplying layer and said image transfer facilitating layer being constructed in such a manner that (1) the concentration of said sublimation dye in said dye supplying layer is greater than that of said sublimable dye in said image transfer facilitating layer or (2) the diffusion coefficient of said sublimable dye in said dye supplying layer is greater than that of said sublimable dye in said image transfer facilitating layer.

2. The sublimation type thermosensitive image transfer recording medium as claimed in claim 1, wherein the particle size of said granules of said sublimable dye in said dye supplying layer is in the range from 0.01 μm to 20 μm.

3. The sublimation type thermosensitive image transfer recording medium as claimed in claim 1, wherein the outer surface of said ink layer has an average center-line-roughness (Ra) of 1.0 μm or less.

4. The sublimation type thermosensitive image transfer recording medium as claimed in claim 1, wherein the surface of said ink layer has an average center-line-roughness of more than 1.0 μm and a mean spacing (Sm) of 10 μm or less between the irregularities of the outer surface of said ink layer.

5. The sublimation type thermosensitive image transfer recording medium as claimed in claim 1, wherein said support is an aromatic polyamide film backed with a heat-resistant lubricating layer formed on the opposite side to said dye supplying layer with respect to said support.

6. The sublimation type thermosensitive image transfer recording medium as claimed in claim 1, wherein said sublimable dye in said dye supplying layer and in said image transfer facilitating layer is volatilized or sublimed at 60° C. or above.

7. The sublimation type thermosensitive image transfer recording medium as claimed in claim 1, wherein the concentration of said sublimable dye in said dye supplying layer is 5 wt. % to 80 wt. %.

8. The sublimation type thermosensitive image transfer recording medium as claimed in claim 1, wherein the concentration of said sublimable dye in said image transfer facilitating layer is 5 wt. % to 80 wt. %.

9. The sublimation type thermosensitive image transfer recording medium as claimed in claim 1, wherein the concentration of said sublimation dye in said dye supplying layer is 1.1 to 5 times the concentration of said sublimation dye in said image transfer facilitating layer.

10. The sublimation type thermosensitive image transfer recording medium as claimed in claim 1, wherein said binder agent in said dye supplying layer is a reaction product of an isocyanate and a polymeric compound having an active hydrogen.

11. The sublimation type thermosensitive image transfer recording medium as claimed in claim 10, wherein said polymeric compound having an active hydrogen is selected from the group consisting of polyvinyl butyral, polyvinyl acetal, polyurethane polyol, polyether polyol, polyester polyol, acrylic resin, an acryl-polyester copolymer, alkyd resin, silicone polyester, epoxy resin whose epoxy ring is opened with alkanolamine and converted so as to have —OH groups.

12. The sublimation type thermosensitive image transfer recording medium as claimed in claim 10, wherein said isocyanate is a diisocyanate.

13. The sublimation type thermosensitive image transfer recording medium as claimed in claim 12, wherein said diisocyanate is selected from the group consisting of 2,4-tolylene diisocyanate, 2,6-tolylene diisocyanate, 4,4'-diphenylmethane diisocyanate, hexamethylene diisocyanate, xylene diisocyanate, isophorone diisocyanate, bisisocyanate methylcyclohexane, and trimethylhexamethylene diisocyanate.

14. The sublimation type thermosensitive image transfer recording medium as claimed in claim 10, wherein said isocyanate is triphenylmethane triisocyanate.

15. The sublimation type thermosensitive image transfer recording medium as claimed in claim 1, wherein said dye supplying layer further comprises a reaction product of an isocyanate and a polymeric compound having an active hydrogen.

16. The sublimation type thermosensitive image transfer recording medium as claimed in claim 15, wherein said polymeric compound having an active hydrogen is selected from the group consisting of polyvinyl butyral, polyvinyl acetal, polyurethane polyol, polyether polyol, polyester polyol, acrylic resin, an acryl-polyester copolymer, alkyd resin, silicone polyester, epoxy resin whose epoxy ring is opened with alkanolamine and converted so as to have —OH groups.

17. The sublimation type thermosensitive image transfer recording medium as claimed in claim 15, wherein said isocyanate is a diisocyanate.

18. The sublimation type thermosensitive image transfer recording medium as claimed in claim 17, wherein said diisocyanate is selected from the group consisting of 2,4-tolylene diisocyanate, 2,6-tolylene diisocyanate, 4,4'-diphenylmethane diisocyanate, hexamethylene diisocyanate, xylene diisocyanate, isophorone diisocyanate, bisisocyanate methylcyclohexane, and trimethylhexamethylene diisocyanate.

19. The sublimation type thermosensitive image transfer recording medium as claimed in claim 15, wherein said isocyanate is triphenylmethane triisocyanate.

20. The sublimation type thermosensitive image transfer recording medium as claimed in claim 1, wherein said binder agent in said dye supplying layer and said image transfer facilitating layer is selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-containing resin, butyral resin, melamine resin, natural rubber, synthetic rubber, polyvinyl alcohol, and cellulose resins.

21. The sublimation type thermosensitive image transfer recording medium as claimed in claim 1, wherein said binder agent in said dye supplying layer is a reaction product of an isocyanate and a polymeric compound having an active hydrogen, and said binder agent in said image transfer facilitating layer is selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-containing resin, butyral resin, melamine resin, natural rubber, synthetic rubber, polyvinyl alcohol, and cellulose resins.

22. The sublimation type thermosensitive image transfer recording medium as claimed in claim 1, wherein said dye supplying layer is thicker than said image transfer facilitating layer and has a thickness in the range of 0.1 μm to 20 μm, and said image transfer facilitating layer has a thickness of 0.05 μm to 5 μm.

23. A thermosensitive recording method comprising the steps of:

(1) superimposing a sublimation type thermosensitive image transfer recording medium on a receiving sheet, which sublimation type thermosensitive image transfer recording medium comprising a support, an ink layer formed on said support, which comprises (a) a dye supplying layer formed on said support, comprising a sublimable dye and at least one binder agent in which said sublimable dye is dispersed in the form of undissolved granules, and (b) an image transfer facilitating layer formed on said dye supplying layer, comprising the sublimable dye and at least one organic binder agent in which said sublimable dye is dissolved, said dye supplying layer and said image transfer facilitating layer being constructed in such a manner that (i) the concentration of said sublimation dye in said dye supplying layer is greater than that of said sublimable dye in said image transfer facilitating layer or (ii) the diffusion coefficient of said sublimable dye in said dye supplying layer is greater than that of said sublimable dye in said image transfer facilitating layer, and (ii) applying heat imagewise to said sublimation type thermosensitive image transfer recording medium so as to imagewise transfer said sublimable dye from said recording medium to said receiving sheet by a heat application recording means as said recording medium and said receiving sheet are moved at an equal speed.

24. The thermosensitive recording method as claimed in claim 23, wherein the particle size of said granules of said sublimable dye in said dye supplying layer is in the range from 0.01 μm to 20 μm.

25. The thermosensitive recording method as claimed in claim 23, wherein the outer surface of said ink layer has an average center-line-roughness (Ra) of 1.0 μm or less.

26. The thermosensitive recording method as claimed in claim 23, wherein the outer surface of said ink layer has an average center-line-roughness of more than 1.0

μm and a mean spacing (Sm) of 10 μm or less between the irregularities of the surface of said ink layer.

27. The thermosensitive recording method as claimed in claim 23, wherein said support is an aromatic polyamide film backed with a heat-resistant lubricating layer formed on the opposite side to said dye supplying layer with respect to said support.

28. The thermosensitive recording method as claimed in claim 23, wherein said sublimable dye in said dye supplying layer and in said image transfer facilitating layer is volatilized or sublimed at 60° C. or above.

29. The thermosensitive recording method as claimed in claim 23, wherein the concentration of said sublimable dye in said dye supplying layer is 5 wt. % to 80 wt. %.

30. The thermosensitive recording method as claimed in claim 23, wherein the concentration of said sublimable dye in said image transfer facilitating layer is 5 wt. % to 80 wt. %.

31. The thermosensitive recording method as claimed in claim 23, wherein the concentration of said sublimation dye in said dye supplying layer is 1.1 to 5 times the concentration of said sublimation dye in said image transfer facilitating layer.

32. The thermosensitive recording method as claimed in claim 23, wherein said binder agent in said dye supplying layer is a reaction product of an isocyanate and a polymeric compound having an active hydrogen.

33. The thermosensitive recording method as claimed in claim 32, wherein said polymeric compound having an active hydrogen is selected from the group consisting of polyvinyl butyral, polyvinyl acetal, polyurethane polyol, polyether polyol, polyester polyol, acrylic resin, an acryl-polyester copolymer, alkyd resin, silicone polyester, epoxy resin whose epoxy ring is opened with alkanolamine and converted so as to have —OH groups.

34. The thermosensitive recording method as claimed in claim 32, wherein said isocyanate is a diisocyanate.

35. The thermosensitive recording method as claimed in claim 34, wherein said diisocyanate is selected from the group consisting of 2,4-tolylene diisocyanate, 2,6-tolylene diisocyanate, 4,4'-diphenylmethane diisocyanate, hexamethylene diisocyanate, xylene diisocyanate, isophorone diisocyanate, bisisocyanate methylcyclohexane, and trimethylhexamethylene diisocyanate.

36. The thermosensitive recording method as claimed in claim 32, wherein said isocyanate is triphenylmethane triisocyanate.

37. The thermosensitive recording method as claimed in claim 23, wherein said dye supplying layer further comprises a reaction product of an isocyanate and a polymeric compound having an active hydrogen.

38. The thermosensitive recording method as claimed in claim 37, wherein said polymeric compound having an active hydrogen is selected from the group consisting of polyvinyl butyral, polyvinyl acetal, polyurethane polyol, polyether polyol, polyester polyol, acrylic resin, an acryl-polyester copolymer, alkyd resin, silicone polyester, epoxy resin whose epoxy ring is opened with alkanolamine and converted so as to have —OH groups.

39. The thermosensitive recording method as claimed in claim 37, wherein said isocyanate is a diisocyanate.

40. The thermosensitive recording method as claimed in claim 39, wherein said diisocyanate is selected from the group consisting of 2,4-tolylene diisocyanate, 2,6-tolylene diisocyanate, 4,4'-diphenylmethane diisocyanate, hexamethylene diisocyanate, xylene diisocyanate, isophorone diisocyanate, bisisocyanate methylcyclohexane, and trimethylhexamethylene diisocyanate.

41. The thermosensitive recording method as claimed in claim 37, wherein said isocyanate is triphenylmethane triisocyanate.

42. The thermosensitive recording method as claimed in claim 23, wherein said binder agent in said dye supplying layer and said image transfer facilitating layer is selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-containing resin, butyral resin, melamine resin, natural rubber, synthetic rubber, polyvinyl alcohol, and cellulose resins.

43. The thermosensitive recording method as claimed in claim 23, wherein said binder agent in said dye supplying layer is a reaction product of an isocyanate and a polymeric compound having an active hydrogen, and said binder agent in said image transfer facilitating layer is selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-containing resin, butyral resin, melamine resin, natural rubber, synthetic rubber, polyvinyl alcohol, and cellulose resins.

44. The thermosensitive recording method as claimed in claim 23, wherein said dye supplying layer is thicker than said image transfer facilitating layer and has a thickness in the range of 0.1 μm to 20 μm, and said image transfer facilitating layer has a thickness of 0.05 μm to 5 μm.

45. A thermosensitive recording method comprising the steps of:

(1) superimposing a sublimation type thermosensitive image transfer recording medium on a receiving sheet, which sublimation type thermosensitive image transfer recording medium comprising a support, an ink layer formed on said support, which comprises (a) a dye supplying layer formed on said support, comprising a sublimable dye and at least one binder agent in which said sublimable dye is dispersed in the form of undissolved granules, and (b) an image transfer facilitating layer formed on said dye supplying layer, comprising the sublimable dye and at least one organic binder agent in which said sublimable dye is dissolved, said dye supplying layer and said image transfer facilitating layer being constructed in such a manner that (i) the concentration of said sublimation dye in said dye supplying layer is greater than that of said sublimable dye in said image transfer facilitating layer or (ii) the diffusion coefficient of said sublimable dye in said dye supplying layer is greater than that of said sublimable dye in said image transfer facilitating layer, and (ii) applying heat imagewise to said sublimation type thermosensitive image transfer recording medium so as to imagewise transfer said sublimable dye from said recording medium to said receiving sheet by a heat application recording means as said recording medium and said receiving sheet are moved in such a manner that the running speed of said recording medium is smaller than that of said receiving sheet.

46. The thermosensitive recording method as claimed in claim 45, wherein the particle size of said granules of said sublimable dye in said dye supplying layer is in the range from 0.01 μm to 20 μm.

47. The thermosensitive recording method as claimed in claim 45, wherein the outer surface of said ink layer has an average center-line-roughness (Ra) of 1.0 μm or less.

48. The thermosensitive recording method as claimed in claim 45, wherein the outer surface of said ink layer has an average center-line-roughness of more than 1.0 μm and a mean spacing (Sm) of 10 μm or less between the irregularities of the surface of said ink layer.

49. The thermosensitive recording method as claimed in claim 45, wherein said support is an aromatic polyamide film backed with a heat-resistant lubricating layer formed on the opposite side to said dye supplying layer with respect to said support.

50. The thermosensitive recording method as claimed in claim 45, wherein said sublimable dye in said dye supplying layer and in said image transfer facilitating layer is volatilized or sublimed at 60° C. or above.

51. The thermosensitive recording method as claimed in claim 45, wherein the concentration of said sublimable dye in said dye supplying layer is 5 wt. % to 80 wt. %.

52. The thermosensitive recording method as claimed in claim 45, wherein the concentration of said sublimable dye in said image transfer facilitating layer is 5 wt. % to 80 wt. %.

53. The thermosensitive recording method as claimed in claim 45, wherein the concentration of said sublimation dye in said dye supplying layer is 1.1 to 5 times the concentration of said sublimation dye in said image transfer facilitating layer.

54. The thermosensitive recording method as claimed in claim 45, wherein said binder agent in said dye supplying layer is a reaction product of an isocyanate and a polymeric compound having an active hydrogen.

55. The thermosensitive recording method as claimed in claim 54, wherein said polymeric compound having an active hydrogen is selected from the group consisting of polyvinyl butyral, polyvinyl acetal, polyurethane polyol, polyether polyol, polyester polyol, acrylic resin, an acryl-polyester copolymer, alkyd resin, silicone polyester, epoxy resin whose epoxy ring is opened with alkanolamine and converted so as to have —OH groups.

56. The thermosensitive recording method as claimed in claim 54, wherein said isocyanate is a diisocyanate.

57. The thermosensitive recording method as claimed in claim 56, wherein said diisocyanate is selected from the group consisting of 2,4-tolylene diisocyanate, 2,6-tolylene diisocyanate, 4,4'-diphenylmethane diisocyanate, hexamethylene diisocyanate, xylene diisocyanate, isophorone diisocyanate, bisisocyanate methylcyclohexane, and trimethylhexamethylene diisocyanate.

58. The thermosensitive recording method as claimed in claim 54, wherein said isocyanate is triphenylmethane triisocyanate.

59. The thermosensitive recording method as claimed in claim 45, wherein said dye supplying layer further comprises a reaction product of an isocyanate and a polymeric compound having an active hydrogen.

60. The thermosensitive recording method as claimed in claim 59, wherein said polymeric compound having an active hydrogen is selected from the group consisting of polyvinyl butyral, polyvinyl acetal, polyurethane polyol, polyether polyol, polyester polyol, acrylic resin, an acryl-polyester copolymer, alkyd resin, silicone polyester, epoxy resin whose epoxy ring is opened with alkanolamine and converted so as to have —OH groups.

61. The thermosensitive recording method as claimed in claim 59, wherein said isocyanate is a diisocyanate.

62. The thermosensitive recording method as claimed in claim 61, wherein said diisocyanate is selected from the group consisting of 2,4-tolylene diisocyanate, 2,6-tolylene diisocyanate, 4,4'-diphenylmethane diisocyanate, hexamethylene diisocyanate, xylene diisocyanate, isophorone diisocyanate, bisisocyanate methylcyclohexane, and trimethylhexamethylene diisocyanate.

63. The thermosensitive recording method as claimed in claim 59, wherein said isocyanate is triphenylmethane triisocyanate.

64. The thermosensitive recording method as claimed in claim 45, wherein said binder agent in said dye supplying layer and said image transfer facilitating layer is selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-containing resin, butyral resin, melamine resin, natural rubber, synthetic rubber, polyvinyl alcohol, and cellulose resins.

65. The thermosensitive recording method as claimed in claim 45, wherein said binder agent in said dye supplying layer is a reaction product of an isocyanate and a polymeric compound having an active hydrogen, and said binder agent in said image transfer facilitating layer is selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-containing resin, butyral resin, melamine resin, natural rubber, synthetic rubber, polyvinyl alcohol, and cellulose resins.

66. The thermosensitive recording method as claimed in claim 45, wherein said dye supplying layer is thicker than said image transfer facilitating layer and has a thickness in the range of 0.1 μm to 20 μm, and said image transfer facilitating layer has a thickness of 0.05 μm to 5 μm.

* * * * *